US007530401B2

(12) United States Patent
Smith et al.

(10) Patent No.: US 7,530,401 B2
(45) Date of Patent: May 12, 2009

(54) TOOL TRAP ASSEMBLY AND METHOD

(76) Inventors: Max H. Smith, 3112 W. Levingwood Rd., Lake Charles, LA (US) 70611; Douglas B. Leeth, P.O. Box 17137, Lake Charles, LA (US) 70616; John A. Lemke, 502 Russell Ave., Lot C, Welsh, LA (US) 70591

( * ) Notice: Subject to any disclaimer, the term of this patent is extended or adjusted under 35 U.S.C. 154(b) by 234 days.

(21) Appl. No.: 11/568,242

(22) PCT Filed: May 3, 2005

(86) PCT No.: PCT/US2005/015193

§ 371 (c)(1),
(2), (4) Date: Oct. 24, 2006

(87) PCT Pub. No.: WO2005/108744

PCT Pub. Date: Nov. 17, 2005

(65) Prior Publication Data

US 2008/0236838 A1 Oct. 2, 2008

Related U.S. Application Data

(60) Provisional application No. 60/567,706, filed on May 3, 2004.

(51) Int. Cl.
*E21B 34/14* (2006.01)

(52) U.S. Cl. ..... 166/382; 166/332.8

(58) Field of Classification Search ..... 166/382, 166/332.8, 373, 332.1
See application file for complete search history.

(56) References Cited

U.S. PATENT DOCUMENTS

| | | | | |
|---|---|---|---|---|
| 3,289,691 | A * | 12/1966 | Kennard | 137/496 |
| 4,506,729 | A * | 3/1985 | Davis et al. | 166/66.5 |
| 6,619,388 | B2 * | 9/2003 | Dietz et al. | 166/66.7 |
| 6,666,271 | B2 * | 12/2003 | Deaton et al. | 166/332.8 |
| 2003/0155131 | A1 * | 8/2003 | Vick, Jr. | 166/375 |

* cited by examiner

*Primary Examiner*—William P Neuder
(74) *Attorney, Agent, or Firm*—David B. Dickinson

(57) ABSTRACT

An apparatus (100) and a method to prevent undesired objects (not shown) when communication conduit (not shown) is disposed therethrough. The apparatus (100) and method include a flapper assembly (150) to selectively open and close when objects (not shown) larger than the communications conduit (not shown) are desired to pass therethrough.

11 Claims, 2 Drawing Sheets

TOOL TRAP ASSEMBLY AND METHOD

Applicants respectfully claim priority to U.S. Provisional Application 60/567,706 filed 3 May 2004, and PCT Application No. PCT/US2005/015193 filed 3 May 2005.

BACKGROUND OF THE INVENTION

Well drilling operations are typically performed using a long assembly of threadably connected pipe sections called a drillstring. Often, the drillstring is rotated at the surface by equipment on the rig thereby rotating a drill bit attached to a distal end of the drillstring downhole. Weight, usually by adding heavy collars behind the drill bit, is added to urge the drill bit deeper as the drillstring and bit are rotated. Because subterranean drilling generates a lot of heat and cuttings as the formation below is pulverized, drilling fluid, or mud, is pumped down to the bit from the surface.

Typically, drill pipe sections are hollow and threadably engage each other so that the bores of adjacent pipe sections are hydraulically isolated from the "annulus" formed between the outer diameter of the drillstring and the inner diameter of the wellbore (either cased or as drilled). Drilling mud is then typically delivered to the drill bit through the bore of the drillstring where it is allowed to lubricate the drill bit through ports and return with any drilling cuttings through the annulus.

Measurements of formation density, porosity, and permeability frequently need to be taken before a well is drilled deeper or before a change in drilling direction is made. Often, measurements relating to directional surveying are needed to ensure the wellbore is being drilled according to plan. Preferably, these measurements and operations can be performed with a measurement while drilling assembly (MWD), whereby the measurements are made in real-time at or proximate to the drill bit and subsequently transmitted to operators at the surface through mud-pulse or electromagnetic-wave telemetry. While MWD operations are possible much of the time, manual measurements are often desired either for verification purposes, or the measurements desired are not within the capabilities of the MWD system currently in the wellbore. Additionally, measurements may be required when a drillstring is not in the wellbore, for instance during workover or production. For this reason, measurements are often required by "wireline" or other devices absent the presence of the drillstring. Various tools, communications conduits, and method are used in the oilfield today to perform measurements or other operations.

For the purposes of this disclosure, the term "tool" is generic and may be applied to any device sent downhole to perform any operation. Particularly, a downhole tool can be used to describe a variety of devices and implements to perform a measurement, service, or task, including, but not limited to, pipe recovery, formation evaluation, directional measurement, and workover. Furthermore, the term communications "conduit," while frequently thought of by the lay person as a tubular member for housing electrical wires, in oilfield parlance, is used to describe anything capable of transmitting fluid, force, electrical, or light communications from one location (surface) to another (downhole). For this reason, the term conduit, as applied with respect to the present disclosure is to include wireline, slick line, coiled tubing, fiber optic cable, and any present or future equivalents thereof.

Often, while wireline or other communications conduit operations are being performed, other work and operations continue on the rig floor. Invariably, accidents occur and objects are dropped down the wellbore where the wireline operations are occurring. This can be the result of human error (or, in some circumstances, intentional behavior on the part of rig personnel), or can be the result of the failure of other equipment. No matter how undesired objects get dropped down the wellbore, they must be retrieved, as such objects can often damage or render inoperable any drilling, production, or measurement equipment located downhole. To retrieve these objects, an expensive and time consuming "fishing" operation is undertaken. Fishing involves the deployment of specialty equipment and personnel to "fish" downhole and retrieve the dropped equipment. This process can be simplified if it is known precisely what has been dropped downhole, but this is not always the case.

Also, objects can fall down the wellbore without personnel on the rig even becoming aware of the object downhole until after equipment has been disrupted or damaged. In this circumstance, the expensive and costly fishing expedition is usually followed with an equally expensive and time-consuming retrieval, repair, and replacement procedure to correct the damaged equipment.

Wireline (or other communications conduit) operations present a special problem in "protecting" the wellbore from foreign objects. Typically a hole cover or other prophylactic device can be placed over the open hole, but when operations are proceeding, this is not an option. A device that prevents the inclusion of foreign objects into the wellbore while still allowing the reciprocating of communications conduit therein is needed.

BRIEF SUMMARY OF THE INVENTION

The deficiencies of the prior art are addressed by a device including a flapper assembly. The device would preferably be placed in a tubular string and would include a bore therethrough preferably large enough for tools disposed upon a communications conduit to pass therethrough. The flapper assembly would include at least two flapper devices, whereby each flapper would be able to raise and lower when actuated. When in the down position, the flappers would have sufficient gap therebetween to allow passage of the communications conduit therethrough but would prevent the passage of objects larger than the communications conduit. In the open position, the flappers would allow the passage of tools and other objects therethrough.

BRIEF DESCRIPTION OF THE DRAWINGS

For a more detailed description of the preferred embodiments of the present invention, reference will be made to the accompanying drawings, wherein.

DETAILED DESCRIPTION OF THE PREFERRED EMBODIMENTS

Figure 1:
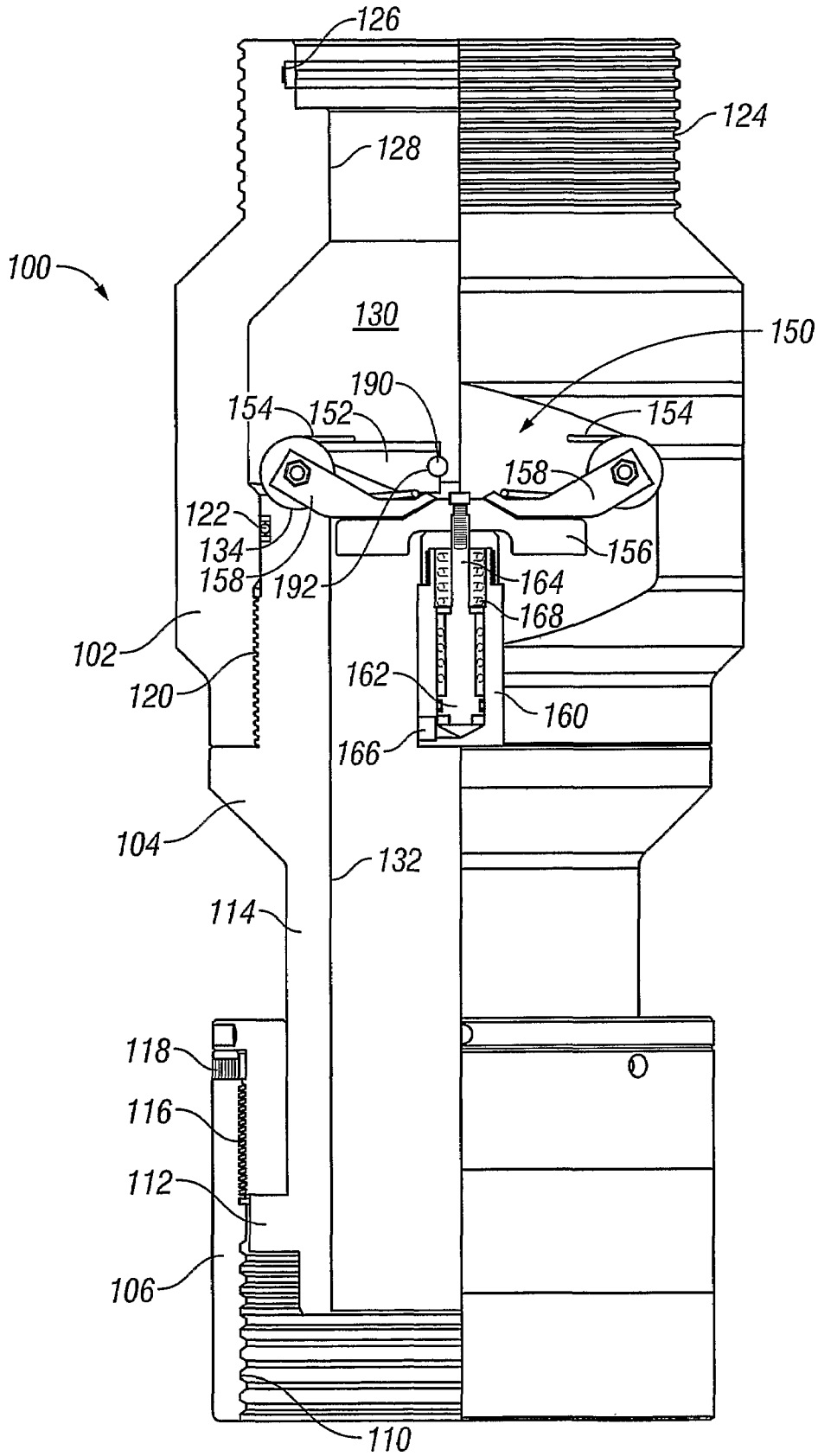
FIG. 1 is a sectioned view profile sketch of a tool trap assembly in accordance with a preferred embodiment of the present invention.

Referring initially to FIG. 1, a tool trap assembly 100 is shown. Tool trap assembly 100 preferably includes a top sub 102, a bottom sub 104, a connection nut 106, and a quick union insert 108. Tool trap assembly 100 is attached atop a tubular string (not shown) by a threaded profile 110 of connection nut 106. Preferably, connection nut 106 is threaded atop the string to be protected and bottom sub 104 is engaged therein. Bottom sub 104 includes a seating flange 112 that is received within the threaded connection nut 106 and seats atop tubular string (not shown). With bottom sub 104 seated within nut 106, quick union insert 108 is threaded down shank 114 of bottom sub 104 and engaged within a second threaded profile 116 of connection nut 106. Quick union insert 108 is preferably tightened until flush with nut 106 and secured in place by engaging a set screw 118 therein. Thereafter, upper sub 102 (if not already made-up with lower sub 104) is threadably engaged atop lower sub 104 at threaded profile 120. Preferably, an elastomeric (or any other type known to one skilled in the art) seal 122 maintains a hydraulic seal between top sub 102 and lower sub 104.

Top sub 102 is preferably configured to allow wireline tools (or tools disposed upon any other form of "conduit" known to one of ordinary skill in the art) to selectively pass therethrough. Top sub 102 also preferably includes a threaded outer profile 124 at its upper end for connection with other threaded devices. It is preferred (but not required) for inner threaded profile 110 of connection nut 106 to correspond with outer threaded profile 124 of top sub 102 so that a threaded joint in a tubular string (not shown) may be separated and tool trap assembly 100 inserted therebetween. Top sub 102 also preferably includes an inside radial seal 126 so that tool trap assembly 100 may sealingly engage a sealing profile from a device connected thereto. Top sub 102 includes an inner bore 128 that opens up to an inner cavity 130 within which lower sub 104 is received. Lower sub 104 preferably includes an inner bore 132 extending from upper sub 102, through shank 114 and past seating flange 112 to a device mounted therebelow.

Figure 2:
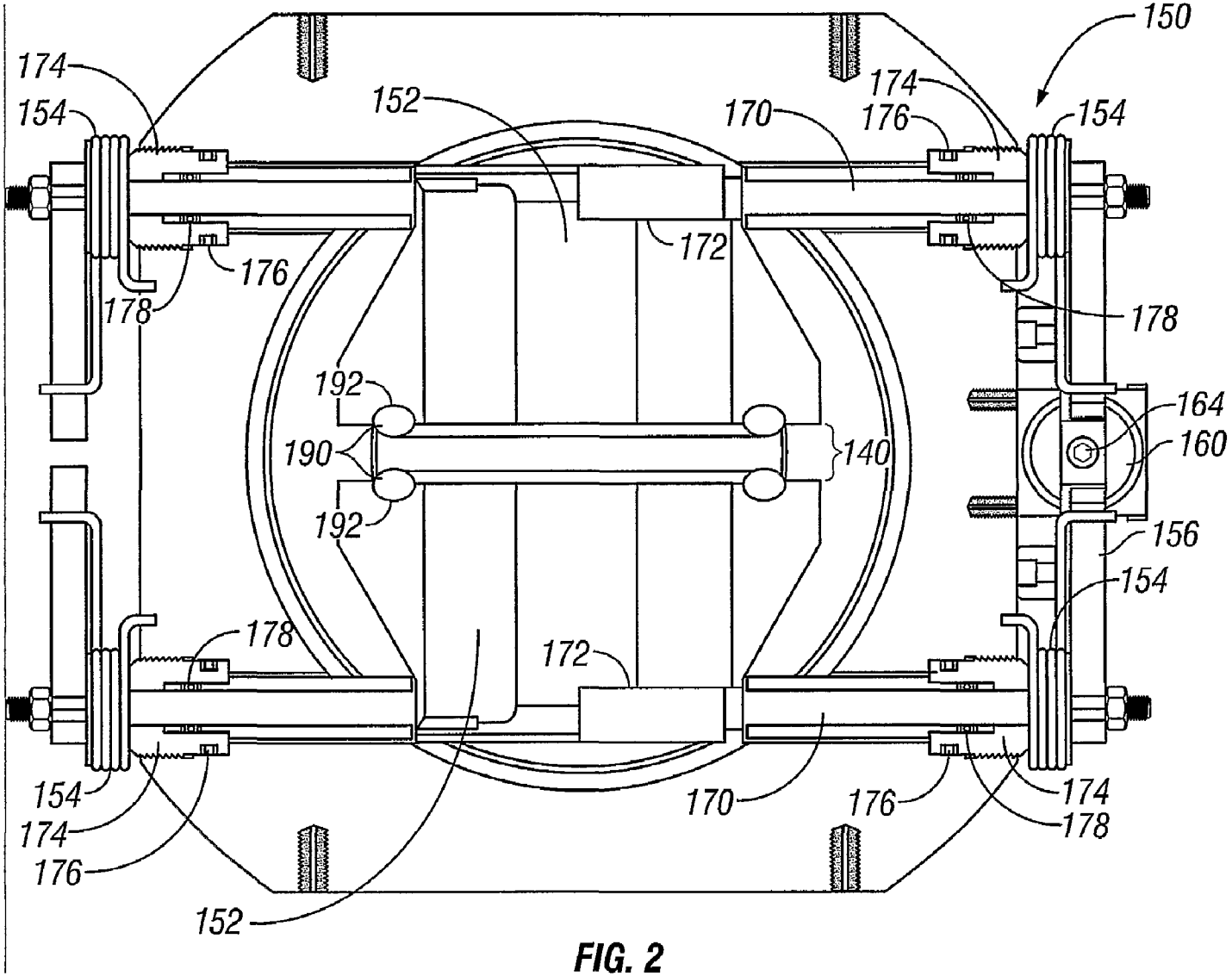
FIG. 2 is a top view sketch of the tool trap assembly of FIG. 1 showing a flapper assembly thereof in greater detail.

Referring now to FIGS. 1 and 2 collectively, housed within cavity 130 of upper sub 102 and atop an upper end 134 of lower sub 104 is a flapper assembly 150. Flapper assembly 150 preferably includes a pair of flappers 152 that are held in a down, or closed, position by a plurality of retainer springs 154. Flappers 152 of assembly 150 act to prevent anything larger than a communications conduit to pass therethrough, where the communications conduit can pass through flapper gap 140 with the flappers 152 in the down position. With flappers 152 in the down, or closed, position as shown, anything dropped down through bore 128 of upper sub 102 (or through any bore thereabove) will be halted by flappers 152 and will not be able to continue down through bore 132 of lower sub, or to any location therebelow. Flappers 152 act to protect downhole equipment and operations from the damage (or costly service interruptions) that can result from the accidental dropping of an object down the hole.

When the opening of flappers 152 of assembly 150 is desired, a hydraulic cylinder 160 connected to a lifting T-bar 156 is actuated, thereby temporarily lifting flappers 152 and allowing items larger than the communications conduit therethrough. Activation of cylinder 160 drives T-bar 156 upward, thereby pushing and rotating actuator arms 158 connected to flappers 152. When the object desired to pass flapper assembly 150 is clear of flappers 152, cylinder 160 is deactivated and springs 154 close flappers 152 to again block access to bore 132 below. While a hydraulic cylinder 160 is shown opening and closing flapper assembly 150, it should be understood by one of ordinary skill in the art that various other devices can be employed to perform this task, including, but not limited to, electrical motors and pneumatic cylinders.

Hydraulic cylinder 160 is preferably constructed as an ordinary device, one that includes a hydraulic piston 162 connected to a shaft 164 that is lifted when pressure through a port 166 is increased. Preferably, a spring 168 biases against upward movement of piston 162 so that shaft 164 is lowered back to its original position when pressure within port 166 is lowered. When flappers 152 are desired to be opened, pressure is increased in port 166, thus driving up shaft 164 and thereby raising T-Bar 156. T-Bar 156 thereby pushes up and rotates actuator arms 158 which are connected to flappers 152 through shafts 170. Shafts 170 are engaged through flappers 152 and include flat profiles that mate with corresponding profiles of flappers 152 at an interface 172. Furthermore, shafts 170 are preferably held in place and hydraulically isolated with respect to tool trap assembly 100 by shaft fittings 174. O-ring seals 176, 178 isolate shaft fittings 174 from tool trap assembly 100 and from shafts 170. Finally, a removable, wear ring 190 is preferably engaged within a socket 192 of each flapper 152 to protect flapper 152 from abrasion and wear from continued rubbing contact with communications conduit run therethrough.

Wear ring 190 can be of any material known to one of ordinary skill in the art but is preferably constructed as round stock for simplicity. In choosing round "bar" stock for wear ring 190, the manufacturing of flappers 152 is simplified. To create sockets 192 for round bar wear rings 190 within flappers 152, a standard circular hole is drilled therethrough and the "hole" is truncated by removing a section thereof, thereby leaving a C-shaped socket 192 behind to hold a bar-stock wear ring 190. Wear ring 190 can be constructed from various materials of various hardness, depending on the philosophy of the operator. For instance, if the communications conduit is desired to be saved from wear with flappers 152, a soft material can be selected for wear ring 190, thereby making wear ring 190 the sacrificial device. Alternatively, if wear on the communications conduit is not a concern, wear ring 190 can be constructed as a hard material, like tungsten carbide, or hardened steel, to ensure that the wear ring 190 has longevity and requires infrequent replacement.

While a preferred embodiment for the locking mechanism of tool trap assembly 100 is shown, it should be understood by one skilled in the art that departures from the specific embodiment disclosed can still be within the scope and meaning of the invention as claimed.

What is claimed:

1. An apparatus located within a tubular string to control access to a wellbore and allow a communications conduit to pass therethrough, the apparatus comprising:

a main body having a bore therethrough, said bore large enough to pass tools disposed upon the communications conduit therethrough;

a flapper assembly contained within said bore, said flapper assembly including a first flapper and a second flapper, each of said flappers having a first position and a second position;

said flappers configured with a predetermined gap therebetween to restrict passage of objects through said bore and to allow the passage and manipulation of the communications conduit through said bore when in said first position; said flappers configured to allow the passage of said objects through said bore when in said second position; and an actuator configured to selectively manipulate said flappers from said first position to said second position when said objects are to pass through said bore.

2. The apparatus of claim 1 wherein said main body further includes a connection to the tubular string at an upper end and at a lower end.

3. The apparatus of claim 1 wherein said flappers include wear rings.

4. The apparatus of claim 3 wherein said wear rings are configured with a hardness less than that of the communications conduit.

5. The apparatus of claim 3 wherein said wear rings are configured with a hardness greater than that of the communications conduit.

6. The apparatus of claim 5 wherein said wear rings comprise hardened steel.

7. The apparatus of claim 5 wherein said wear rings comprise tungsten carbide.

8. The apparatus of claim 1 wherein said actuator is a hydraulic cylinder.

9. The apparatus of claim 8 wherein said hydraulic cylinder includes a spring to bias a piston housed therein to an unenergized state.

10. A method to prevent the passage of objects through a tubular body while a communications conduit is disposed therethrough, the method comprising:

opening a flapper assembly to allow the passage of a tool disposed upon a distal end of the communications conduit therethrough, the flapper assembly including a first flapper and a second flapper;

passing the communications conduit with tools disposed thereupon through the tubular body; and, closing the flapper assembly, the first and second flappers of the flapper assembly providing a gap therebetween to allow the communications conduit to pass therethrough in the closed position.

11. A tool trap assembly to substantially block access to a bore comprising:

a body with a longitudinal bore extending through the body;

an edge of a first flapper pivotably connected to an internal wall of the longitudinal bore of the body, moveable by an actuator connected thereto;

an edge of a second flapper pivotably connected opposite the first flapper to the internal wall of the longitudinal bore of the body, moveable by an actuator connected thereto;

the first flapper extending into the longitudinal bore when moveably actuated to a closed position and retained substantially parallel to the longitudinal bore when moveably actuated to an opened position;

the second flapper extending into the longitudinal bore when moveably actuated to a closed position and retained substantially parallel to the longitudinal bore when moveably actuated to an opened position; and, a distal edge of the first flapper spaced from an adjacent distal edge of the second flapper to restrict the passage of an object larger than a communication conduit into the bore when the first and the second flapper are in the closed position.

* * * * *